US005909610A

United States Patent [19]

Yoshiki et al.

[11] Patent Number: 5,909,610

[45] Date of Patent: Jun. 1, 1999

[54] TONER CONTAINER ENCLOSED IN A PROTECTIVE ARMORING MEMBER

[75] Inventors: Shigeru Yoshiki, Tokyo; Noboru Kusunose, Yokohama, both of Japan

[73] Assignee: Ricoh Company, Ltd., Tokyo, Japan

[21] Appl. No.: 08/872,049

[22] Filed: Jun. 10, 1997

[30] Foreign Application Priority Data

| | | | |
|---|---|---|---|
| Jun. 10, 1996 | [JP] | Japan | 8-147290 |
| Jun. 17, 1996 | [JP] | Japan | 8-155738 |
| Apr. 10, 1997 | [JP] | Japan | 9-092229 |

[51] Int. Cl.[6] ..... G03G 21/18; G03G 15/04; G03G 15/08

[52] U.S. Cl. ..... 399/262; 399/111; 399/112; 399/119; 399/120

[58] Field of Search ..... 399/262, 263, 399/120, 119, 113, 112, 111; 222/DIG. 1

[56] References Cited

U.S. PATENT DOCUMENTS

| | | | |
|---|---|---|---|
| 5,118,013 | 6/1992 | Mutou et al. | 222/DIG. 1 |
| 5,280,324 | 1/1994 | Ono et al. | 222/DIG. 1 |
| 5,416,568 | 5/1995 | Yoshiki et al. . | |
| 5,424,816 | 6/1995 | Fox et al. . | |
| 5,455,662 | 10/1995 | Ichikawa et al. . | |
| 5,500,719 | 3/1996 | Ichikawa et al. . | |
| 5,557,387 | 9/1996 | Hatano . | |
| 5,627,631 | 5/1997 | Ichikawa et al. . | |
| 5,648,840 | 7/1997 | Ikunami et al. | 399/262 |
| 5,722,019 | 2/1998 | Nakajima | 399/262 |

FOREIGN PATENT DOCUMENTS

| | | |
|---|---|---|
| 0 616 268 | 9/1994 | European Pat. Off. . |
| 195 41 680 | 5/1996 | Germany . |
| 05-152375 | 1/1993 | Japan . |

OTHER PUBLICATIONS

Patent Abstracts of Japan, vol. 18, No. 546 (P–1814), Oct. 18, 1994, JP 06–194950, Jul. 15, 1994.

*Primary Examiner*—Richard Moses
*Assistant Examiner*—Shival Virmani
*Attorney, Agent, or Firm*—Oblon, Spivak, McClelland, Maier & Neustadt P.C.

[57] ABSTRACT

A toner cartridge (1000) that is attached to a development unit of an image forming apparatus in order to supply toner to the development unit comprises a toner bottle (100) containing toner, a lid member (200) fitted on a toner outlet **(114*d*) of the toner bottle (100), and an armoring member (300) in which the toner bottle (100) is housed and to which the lid member (200) is attached. The lid member (200) is provided with a toner supply mechanism for supplying the toner contained in the toner bottle (100) to the development unit when the toner cartridge (1000) is attached to the development unit of the image forming apparatus. In the toner cartridge (1000), both of or one of the lid member (200) and the armoring member (300) is shaped quadrangularly in external appearance. The armoring member (300) and the toner bottle (100) are individually constructed so that the toner cartridge (1000) has a double construction comprising the armoring member (300) and the toner bottle (100)**.

14 Claims, 16 Drawing Sheets

TONER CONTAINER ENCLOSED IN A PROTECTIVE ARMORING MEMBER

BACKGROUND OF THE INVENTION

1. Field of the Invention

This invention relates to a toner container used to supply toner to a development unit of an image forming apparatus and relates to the image forming apparatus to which the toner container is attached.

2. Description of the Related Art

An image forming apparatus, such as a copying machine, a printer, or a fax machine, includes a toner supply device for replenishing a development unit with toner. This type of toner supply device comprises a cylindrical toner bottle that contains toner, a holding means for holding the toner bottle substantially horizontally in a state where the toner bottle is in connection with a toner-introducing portion of the development unit, and a rotation drive means for rotating the held toner bottle on its center axis. The toner bottle is of a screw bottle type having a spiral rib on the inner surface of the bottle. When the toner bottle is rotated by the rotation drive means, the toner in the bottle is conveyed toward a toner discharge opening of the bottle along the spiral rib and is discharged therefrom. In this way, the development unit is replenished with the toner.

The image forming apparatus (e.g., copying machine) further includes a heat source, such as a fuser. For this reason, there are instances where the toner in the bottle melts with the heat of the heat source. Even when the toner does not melt therewith, the toner bottle is intensely heated. This lowers the fluidity of the toner in the bottle, thus retarding the toner supply and causing no little toner to adhere to the inner surface of the bottle. Therefore, there occur disadvantages, such as an increase in quantity of the remaining toner in the bottle at the toner end. The disadvantages occur especially in a compact image forming apparatus, generally called a process cartridge, having a construction in which a photoconductor and its peripheral equipment are contained in a compact case in the form of a unit. The reason is that, in the compact image forming apparatus, a toner supply device and a heat source are close to each other.

Conventionally, in order to solve the disadvantages, there are known a developer container disclosed by Japanese Patent Application Laid-Open Publication No. Hei 3-271782, a toner supply container disclosed by Japanese Patent Application Laid-Open Publication No. Hei 6-194950, and so forth. The conventional container has a double construction comprising an outer cylindrical portion and an inner cylindrical portion so that the toner in the container is prevented from melting or hardening under the influence of heat, moisture, and the like.

The aforementioned toner supply device has a simple construction and therefore is manufactured at small cost. However, since the toner is supplied in a state where the toner bottle is held substantially horizontally, the toner discharge opening must be opened or closed with a stopper when supplying the toner. Therefore, it is required to mount a lid member of the toner bottle, an opening-and-closing mechanism for opening and closing the toner discharge opening with the stopper, and the like, on the side of the image forming apparatus. This is an obstacle to making the image forming apparatus more compact and reducing the manufacturing costs. Additionally, the conventional toner bottle of the screw bottle type cannot control a toner replenishment by itself and cannot singly serve as a toner supply device. For this reason, there is a need to mount a toner replenishment control means, such as a toner hopper, on the side of the image forming apparatus.

Generally, this type of toner supply device further has a seal member for preventing toner leakage. Especially, the seal member disposed at a sliding portion requires durability. However, if a polyurethane foam (i.e., sponge) of low cost, for example, is used as the seal member, there is a fear that the sealing power thereof will decline because of long-term use of the device. Therefore, in the conventional toner supply device, the sealing power of the sealing member must be retained according to the life of the device. In other words, a seal member of low cost, such as a sponge, cannot be used.

A toner container in which a toner bottle is provided with a lid member has been already proposed by the present applicant. Because of being shaped like a cylinder in outward appearance, this toner bottle is liable to roll when placed horizontally and is restricted in handling. Additionally, because of being generally made of polyethylene, this type of toner bottle is small in rigidity, and a fixing portion of the lid member is liable to be deformed. In other words, the toner bottle does not have sufficient mounting strength.

On the other hand, a toner container having a double construction comprising an outer cylindrical portion and an inner cylindrical portion is recyclable by refilling it with new toner. However, since the outer and inner cylindrical portions are formed integrally with each other, or since the outer cylindrical portion is provided with a toner supply portion, the whole container including the outer cylindrical portion is contaminated with toner during a single use. Therefore, in order to use it again, it is required to clean almost all the constituent parts including the outer cylindrical portion. Thus, the toner container having this type of double construction is unsuitable for recycling.

Additionally, in the conventional toner container, all the combined parts of the outer cylindrical portion must be sealed by welding, gluing, or adhesion of a seal member so as to prevent toner leakage. Thus, the toner container is difficult to have a simple construction. Additionally, when the conventional toner container is refilled with new toner, the new toner must be provided from a toner-introducing opening of the outer cylindrical portion by the use of exclusive equipment. Thus, the toner container is inferior in productivity.

Additionally, in a toner container provided with a toner supply mechanism, such as an agitator, or a toner container provided with a tapping member whose vibrations prevent toner from adhering to the inner surface of the container, there is a problem in that a noise is produced when the agitator or tapping member operates.

SUMMARY OF THE INVENTION

It is an object of the present invention to provide a toner container which is capable of handling well without rolling when placed horizontally, lessening the influence of heat on toner contained therein, and abating a noise, and provide an image forming apparatus to which the toner container is attached.

In order to achieve the object, the toner container according to a first aspect of the present invention comprises a toner containing member containing the toner, a lid member having a toner discharge opening from which the toner conveyed through a toner outlet of the toner containing member is discharged, and an armoring member in which the toner containing member is housed and to which the lid member is attached. In this toner container, both of or one of the lid member and the armoring member is shaped quadrangularly in external appearance.

According to the first aspect of the present invention, since both of or one of the lid member and the armoring member is shaped quadrangularly in external appearance, the toner container is difficult to roll even if it is placed horizontally, and is therefore excellent in handling. Additionally, since the toner containing member is housed in the armoring member, the toner container is greater in assembly strength than a conventional toner container consisting of a toner bottle and a lid member.

Preferably, in the toner container according to the first aspect of the present invention, the lid member has a toner supply mechanism for supplying the toner conveyed from the toner outlet of the toner containing member to a development unit through the toner discharge opening of the lid member.

Since there is no need to mount a closing-stopper mechanism on the side of the image forming apparatus by providing the lid member with the toner supply mechanism, the apparatus can be simplified in structure.

In order to achieve the object, the toner container according to a second aspect of the present invention comprises a toner containing member containing the toner and having a toner outlet through which the toner is discharged, and an armoring member in which the toner containing member is housed. The armoring member is constructed as a constituent part divided from the toner containing member, and the toner container has a double construction comprising the toner containing member and the armoring member.

According to the second aspect of the present invention, since the toner container has the double construction, an operation noise, such as a noise made by sliding, in the toner container is intercepted, and the toner container can deaden the noise. Additionally, since the heat of a heat source, such as a fuser, in the apparatus is difficult to be conducted to the toner containing member because of the double construction of the toner container, the melting of the toner in the toner containing member or other similar disadvantages can be prevented. Moreover, since the armoring member is constructed as a constituent part independent of the toner containing member, the armoring member has no fear of being contaminated with the toner discharged from the toner outlet of the toner containing member, and therefore is recyclable.

Preferably, in the toner container according to the second aspect of the present invention, the toner containing member conveys the toner contained therein to the toner outlet thereof and discharges the toner from the toner outlet by driving force.

If the toner container is thus constructed, the toner outlet of the toner containing member can be made small in diameter because the toner outlet can be disposed at an end of the toner containing member. The smaller outlet makes it possible to prevent toner scatter which occurs when the toner containing member is filled with toner.

Preferably, in the toner container according to the first aspect of the present invention, the toner containing member conveys the toner contained therein to the toner outlet thereof and discharges the toner from the toner outlet by driving force. According to this construction, the same advantage can be obtained as in the toner container according to the second aspect of the present invention.

In order to achieve the object, the toner container according to a third aspect of the present invention comprises a toner containing member containing the toner, a lid member having a toner discharge opening from which the toner conveyed through a toner outlet of the toner containing member is discharged, and an armoring member in which the toner containing member is housed and to which the lid member is attached. The armoring member is constructed independently of the toner containing member, and the toner container has a double construction comprising the toner containing member and the armoring member.

According to the third aspect of the present invention, since the toner container has the double construction, an operation noise and heat are interceptive as in the toner container according to the second aspect of the present invention. Moreover, since the armoring member is constructed as a constituent part independent of the toner containing member, the armoring member has no fear of being contaminated with the toner, and therefore is recyclable.

Preferably, in the toner container according to the third aspect of the present invention, the lid member has a toner supply mechanism for supplying the toner conveyed from the toner outlet of the toner containing member to a development unit through the toner discharge opening of the lid member.

In the thus constructed toner container, the same advantage can be obtained as in the toner container according to the first aspect of the present invention.

Furthermore, preferably, in the toner container according to the third aspect of the present invention, the toner containing member conveys the toner contained therein to the toner outlet thereof and discharges the toner from the toner outlet by driving force.

In the thus constructed toner container, the same advantage can be obtained as in the toner container according to the second aspect of the present invention.

According to the first, second, and third aspects of the present invention, since the toner containing member can be filled with toner by the use of existent filling-equipment, productivity of the toner container can be kept in good condition. Additionally, since there is no need to mount the seal member for toner leakage at a place other than the toner discharge opening (toner discharge portion), it is not required to seal the armoring member, and therefore the toner container can be manufactured easily and at low cost. Additionally, if the toner containing member is a toner bottle of a screw bottle type, there is no need to mount a toner conveying member, such as an agitator. Therefore, the toner container can be simplified in structure.

Additionally, the toner container is designed to be attached to an image forming apparatus constructed as follows.

According to an aspect of the present invention, the image forming apparatus includes a development unit and a toner container used to supply toner to the development unit. In this apparatus, the toner container comprises a toner containing member containing the toner, a lid member having a toner discharge opening from which the toner conveyed through a toner outlet of the toner containing member is discharged, and an armoring member in which the toner containing member is housed and to which the lid member is attached. In the toner container, both of or one of the lid member and the armoring member is shaped quadrangularly in external appearance.

According to another aspect of the present invention, the image forming apparatus includes a development unit and a toner container used to supply toner to the development unit.

In this apparatus, the toner container comprises a toner containing member containing the toner and having a toner outlet through which the toner is discharged, and an armoring member in which the toner containing member is housed. The armoring member is constructed independently of the toner containing member, and the toner container has a double construction comprising the toner containing member and the armoring member.

According to still another aspect of the present invention, the image forming apparatus includes a development unit and a toner container used to supply toner to the development unit. In this apparatus, the toner container comprises a toner containing member containing the toner, a lid member having a toner discharge opening from which the toner conveyed through a toner outlet of the toner containing member is discharged, and an armoring member in which the toner containing member is housed and to which the lid member is attached. The armoring member is constructed independently of the toner containing member, and the toner container has a double construction comprising the toner containing member and the armoring member.

DETAILED DESCRIPTION OF THE PREFERRED EMBODIMENT

Figure 1:
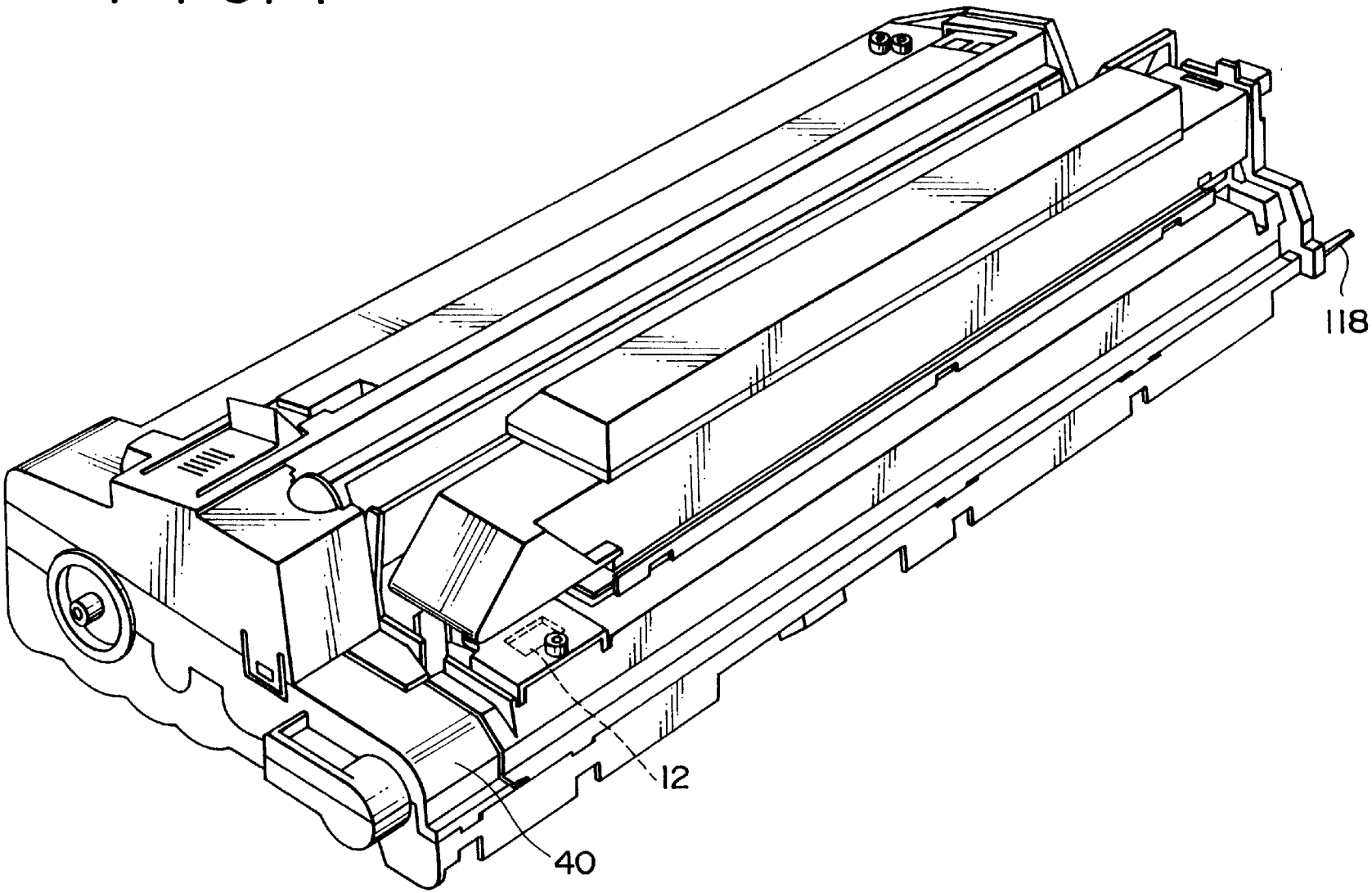
FIG. 1 is a perspective view showing the outward appearance of an image forming apparatus (process cartridge) to which a toner container of the present invention is to be attached.

An embodiment of the present invention will be described in detail with reference to the attached drawings. First, with reference to FIGS. 1 to 3, a description will be provided of an image forming system of an image forming apparatus (a copying machine in this embodiment) to which a toner container according to the present invention is attached. The charge is removed from a photoconductor 1 by illuminating it with electricity-removing light 7 while the photoconductor 1 is rotating in a direction of an arrow shown in FIG. 2. As a result, a surface potential of the photoconductor 1 is leveled to become a reference potential of 0 to −150 v. After that, the photoconductor 1 is charged by a charger 2, so that the surface potential thereof becomes −900 v. or so. An exposure part of the charged photoconductor 1 is illuminated with image-forming light 3 whereas the remaining part (image-forming part) thereof which is not illuminated with the image-forming light 3 is imaged with toner staying on a development roller sleeve 4 of a development unit. At this time, a bias of about −200 v. is applied to the development roller sleeve 4. However, since the image-forming part of the photoconductor 1 that has not been illuminated with the image-forming light 3 maintains the surface potential of −500 to −850 v., the toner on the development roller sleeve 4 adheres to the image-forming part.

Transfer paper is fed from a paper feeder (not shown) while the photoconductor 1 is further rotating. The transfer paper is fed with a given timing with which, in a transfer unit, a coincidence occurs between a front end of the transfer paper and a front end of a toner image formed on the photoconductor 1. At this time, the toner image is transferred to the transfer paper by means of a transfer device 5 of the transfer unit. The transfer paper to which the toner image has been transferred is sent to a fusing unit (not shown). The toner image of the transfer paper is fused by the heat and pressure of a fuser (not shown) of the fusing unit, and thereafter the transfer paper as a duplicate is discharged from the apparatus (i.e., copying machine) outward. On the other hand, the toner remaining on the photoconductor 1 without being transferred to the transfer paper is scraped off by a cleaning blade 6 of a cleaning unit. Thereby, the photoconductor 1 reaches an initial state of having no toner, and preparations are completed for the following image forming process.

Figure 2:
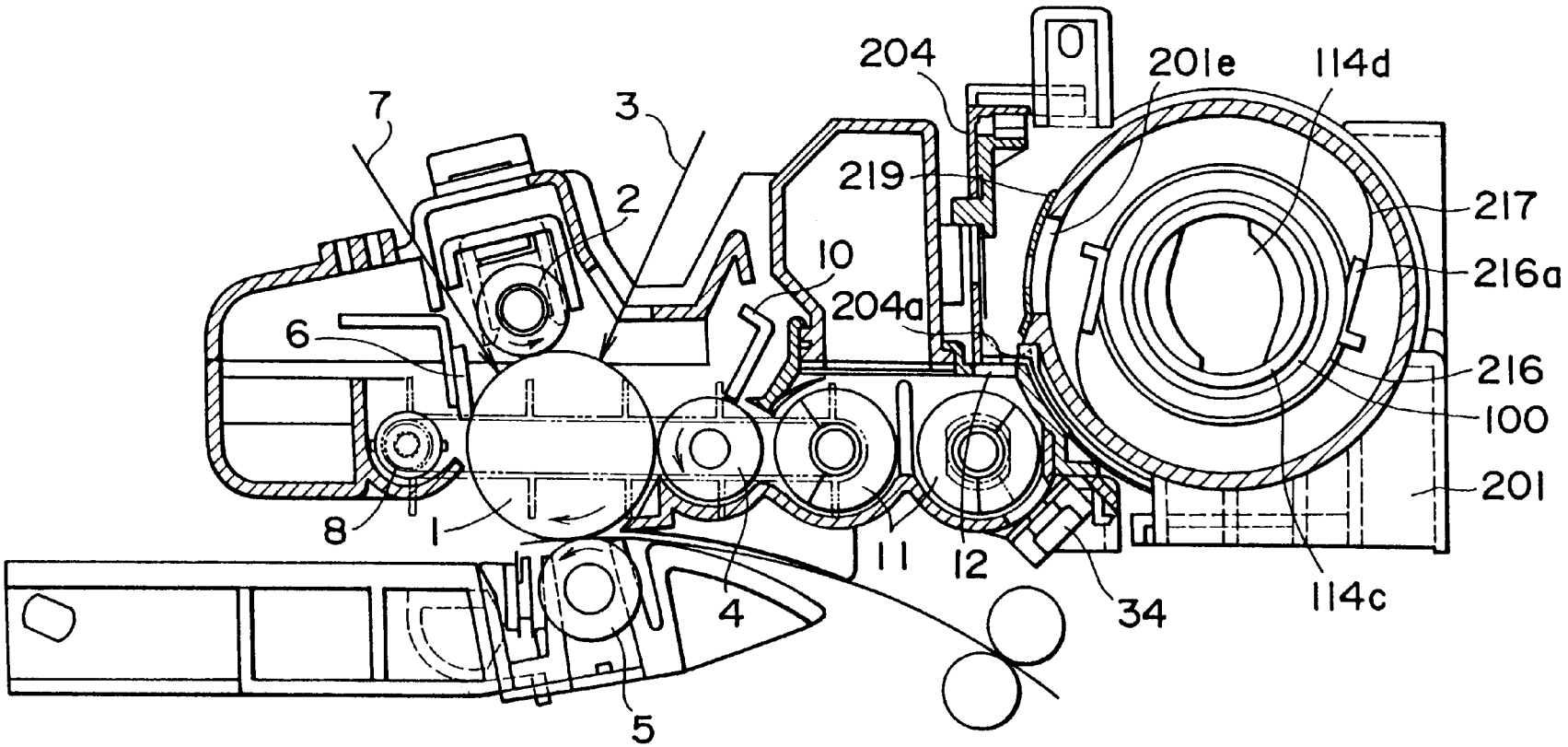
FIG. 2 is a schematic sectional view showing the internal construction of the process cartridge.
Figure 3:
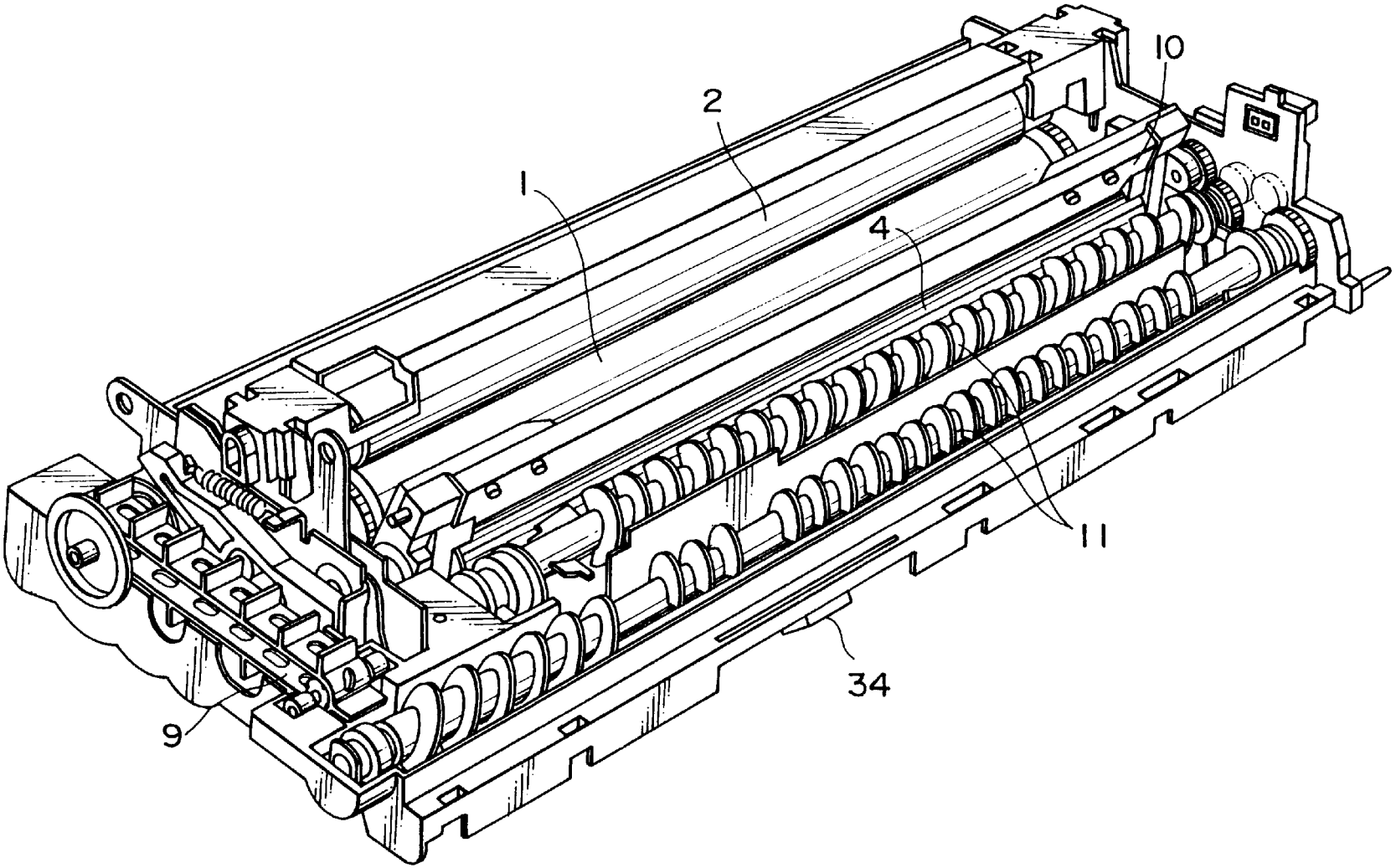
FIG. 3 is a perspective view showing the internal construction of the process cartridge of which an upper case is removed.

In this embodiment, the charging device, the developing device, the cleaning device, which are disposed around the photoconductor, and the photoconductor are unitized and contained in a photoconductor-enclosing case 40 formed integrally. This case 40 is generally called as a process cartridge. The process cartridge has an external appearance as shown in FIG. 1. As shown in FIGS. 2 and 3, in the process cartridge, the remaining toner which has been scraped off with the cleaning blade 6 from the photoconductor 1 is conveyed to a recycle toner conveying unit disposed in front of the case 40 by means of a toner conveying coil 8. The toner is then conveyed to a developer agitating portion of the development unit by means of a toner recycling belt 9 mounted in the recycle toner conveying unit and is used as recycle toner. In this embodiment, the charger 2 and the transfer device 5 are of a roller type. However, the present invention is not limited to this. The present invention is applicable to a corona discharge type which uses wires.

A description will now be provided of the development unit in the process cartridge. In FIGS. 2 and 3, the development roller sleeve 4 has a fixed shaft in which magnets of five poles are mounted. The outer surface of the development roller sleeve 4 is covered with magnetic pipe material, such as aluminum. Because of the rotation of the pipe material, the developer (i.e., two-component developer consisting of a toner powder and carriers of small iron balls) contained in the developer container (case 40) is drawn to the development roller sleeve 4 by the magnetic force of the magnets and then is moved to the development part of the photoconductor 1. In order to prevent the occurrence of the inferiority or nonuniformity of image density caused by an excessive or inadequate supply of the developer, the supply quantity of the developer from the development roller sleeve 4 to the photoconductor 1 is regulated by a doctor blade 10 that serves to make constant an inflow of the developer from the development roller sleeve 4 to the photoconductor 1. The developer container formed integrally with the case 40 includes a pair of agitating screws 11 for agitating and circulating the developer. Corresponding to the rotation of the agitating screws 11, the developer in the developer container is circulated as if to make loops, and is conveyed in an axial direction of the development roller sleeve 4 while being agitated. The carriers of the developer which have flowed to the development part of the photoconductor 1 are taken into the developer container and are again circulated therein by the rotation of the development roller sleeve 4, whereas the toner of the developer which has adhered to the carriers electrically charged by the agitation and has been conveyed to the development part of the photoconductor 1 is caused to adhere to an image forming area of the development part of the photoconductor 1 and is consumed. Accordingly, in this type of image forming apparatus, toner must be opportunely supplied according to the consumption, as widely known. For this reason, as shown in FIGS. 1 and 2, a toner supply opening 12 through which new toner flows into the development container is formed in the upper part of the development container of the case 40 of the process cartridge.

Figure 4:
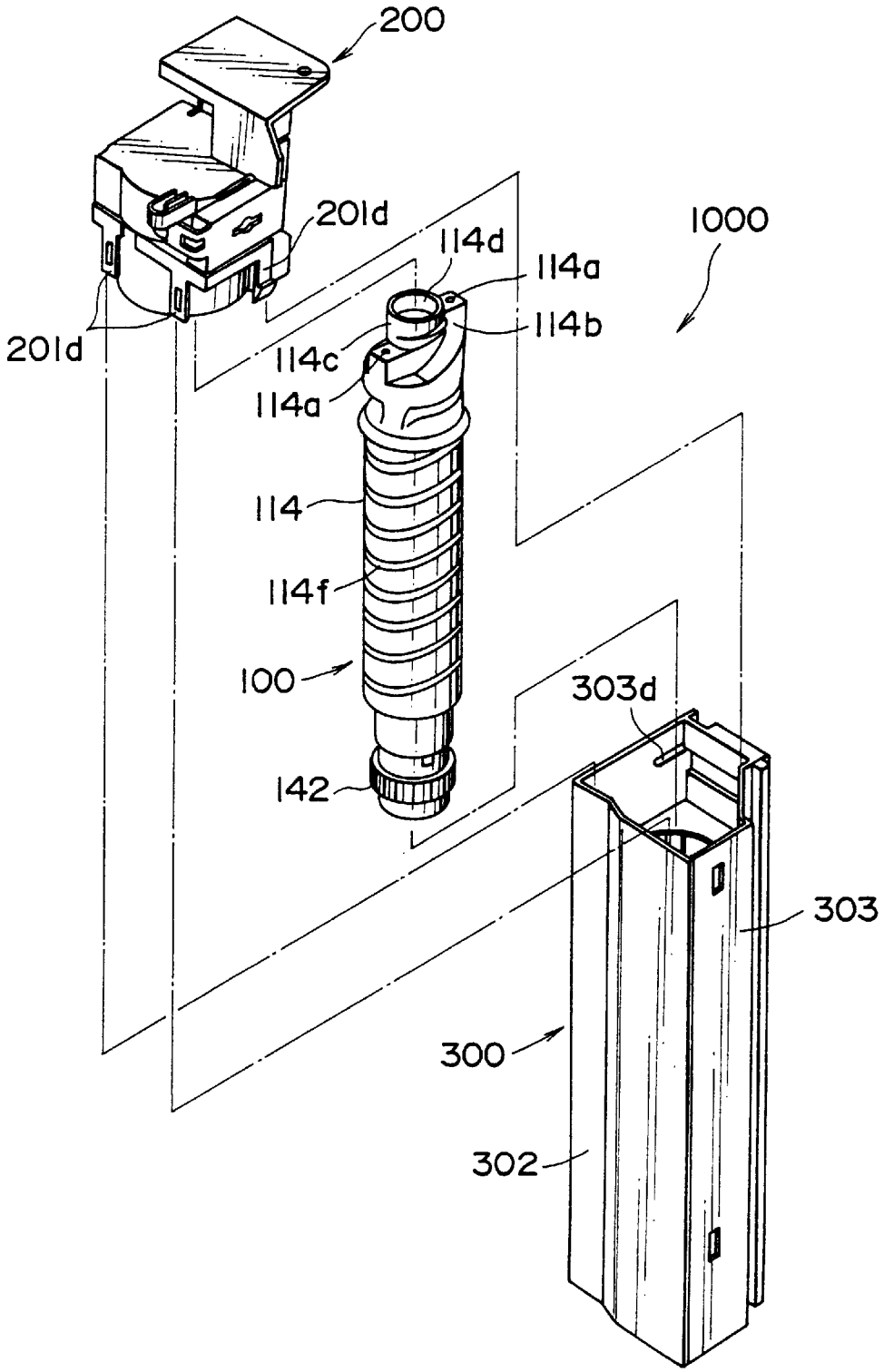
FIG. 4 is an exploded perspective view showing the construction of the toner container of the present invention.

A cartridge type toner container is used to replenish the development container with the new toner through the opening 12. As shown in FIG. 4, the toner container 1000 in this embodiment comprises a toner bottle 100 as a toner containing member which has a screw bottle construction, a lid member 200 attached to a mouth portion 114*c* of the bottle 100 and aligned with a toner discharge opening 114*d* of the bottle 100, and an armoring member 300 enclosing the toner bottle 100.

The lid member 200 is provided with a toner supply mechanism for conveying the toner contained in the bottle 100 from the toner discharge opening 114*d* to the opening 12 of the case 40. This toner supply mechanism will be described later in detail. It is to be noted that a combination of the lid member 200 with the armoring member 300 can be regarded as a divided armoring member.

In this embodiment, the lid member 200 and the armoring member 300 are each shaped substantially like a quadrangle. Instead, they may be shaped like a polygon.

A description will be provided of the assembly of the parts of the toner container 1000. First, with the armoring member 300 upright, the toner bottle 100 whose toner discharge opening 114*d* is in an opened state is inserted into the armoring member 300. After that, the lid member 200 is attached to the toner bottle 100 and the armoring member 300 from above. At this time, the lid member 200 and the armoring member 300 are fixed to each other by the engagement between claws 201*d* formed on the end of the outer surface of the lid member 200 and claws 303*d* formed on the end of the inner surface of the armoring member 300. Thus, an adhesive agent or the like is not required for the assembly. This facilitates the assembly and disassembly of the parts, in other words, facilitates recycling.

As shown in FIG. 4, the toner bottle 100 has a spiral rib 114*f* on the inner surface of a bottle portion 114. Accordingly, when the toner bottle 100 is placed horizontally and is rotated about its center axis, toner contained in the toner bottle 100 is conveyed along the rib 114*f* and is discharged from the toner discharge opening 114*d*. On the bottom of the bottle portion 114 of the toner bottle 100, a bottle gear 142 is mounted which is engaged with a toner container driving gear 115 which will be described later.

Figure 6:
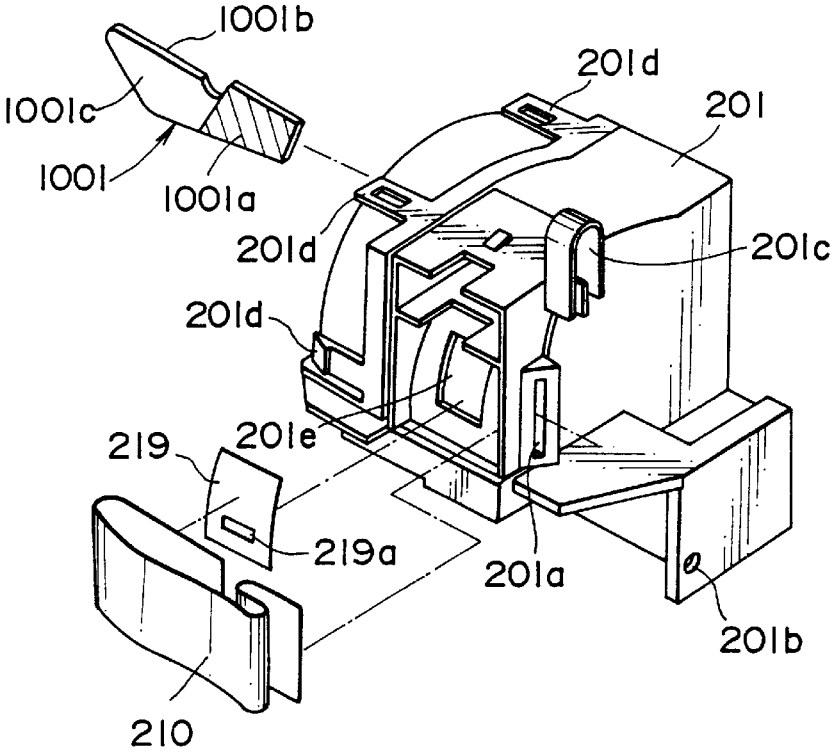
FIG. 6 is an exploded perspective view showing the construction of a lid body of the lid member of the toner container.

The lid member 200 is attached to the mouth portion 114*c* of the toner bottle 100. As shown in FIGS. 2 and 6, an opening 201*e* is formed in the inner surface of a lid body 201 of the lid member 200. A gate 219 is stuck over the opening 201*e* with, for example, adhesive double coated tape. The gate 219 is made of elastic material, such as PET film or rubber, and has a slit 219*a* used to supply an optimum quantity of toner. A gate seal 210 is stuck to the gate 219 (see FIG. 6). The gate seal 210 serves to prevent the toner from leaking out of the slit 219*a* of the gate 219 when the toner container 1000 is in an unused state. After the toner container 1000 is attached to the image forming apparatus, the gate seal 210 is removed from the gate 219. In other words, an end of the gate seal 210, which comes out of a seal-drawing slit 201*a* of the front of the lid body 201, is drawn by a user when the toner is used, and thereby the toner can be supplied.

Figure 7:
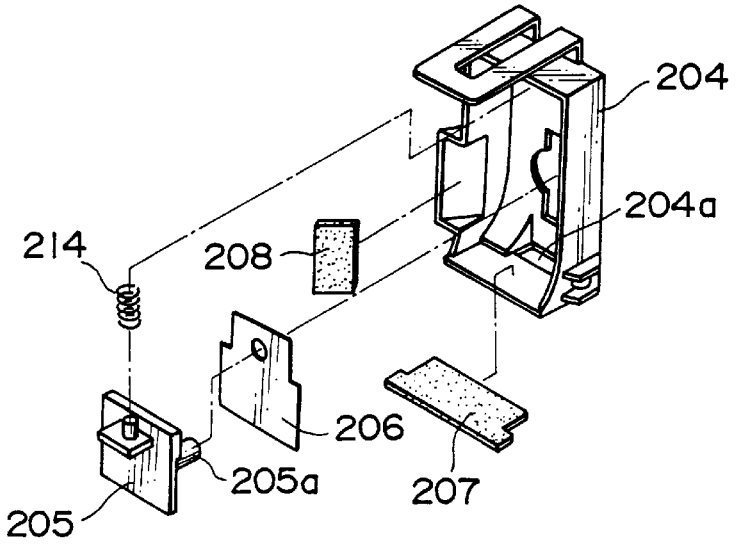
FIG. 7 is an exploded perspective view showing the construction of a toner discharge cover of the lid member of the toner container.

As shown in FIGS. 2 and 7, a toner discharge cover 204 is mounted on the outer opening surface of the lid body 201 so as to cover the gate 219 used as a toner supply opening on the side of the lid body 201. A shutter-opening-and-closing spring 214 and a shutter 205 to which a shutter sheet 206 made of, for example, PET film is stuck with, for example, adhesive double coated tape are attached to the toner discharge cover. When the toner container 1000 is not set in the apparatus, the shutter 205 is always pressed toward the lower part of the toner discharge cover 204 by extensible resilient forth. Thereby, a toner discharge opening 204*a* formed in the lower part of the toner discharge cover 204 is closed with the shutter sheet 206. The toner discharge opening 204*a* of the toner discharge cover 204 can serve as a toner discharge opening on the side of the lid member 200.

On the other hand, when the toner container 1000 is set in the apparatus, a projection 205*a* formed on the shutter 205 is pressed upward along a shutter-opening-and-closing slope (not shown) formed on the side of the apparatus. Thereby, the shutter sheet 206 is moved from the position where the toner discharge opening 204*a* is closed with the shutter sheet 206, so that the toner can flow from the lid member 200 therethrough for replenishment. This shutter mechanism is provided for the purpose of preventing toner leakage when the toner container is handled. The sealing performance for preventing the toner leakage occurring when the toner container 1000 is, for example, transported is ensured by the gate seal 210. A seal member 207 and a seal member 208 are stuck to the toner discharge cover 204 with adhesive double coated tape or the like. The seal member 207 is used to secure the sealing ability between the toner discharge cover 204 and the lower surface of the lid body 201 whereas the seal member 208 is used to prevent toner from leaking from the seal-drawing slit 201*a* of the lid body 201. The seal members 207, 208 are each made of polyurethane foam.

A seal member 212 is further stuck to the lid member 200 with adhesive double coated tape. The seal member 212 is used to ensure the sealing ability between the toner discharge opening 204*a* formed on the side of the lid member 200 and the toner supply opening 12 formed on the side of the development unit when the toner container 1000 is set in the apparatus so as to bring about a coincidence between the toner discharge opening 204*a* and the toner supply opening 12.

Figure 5:
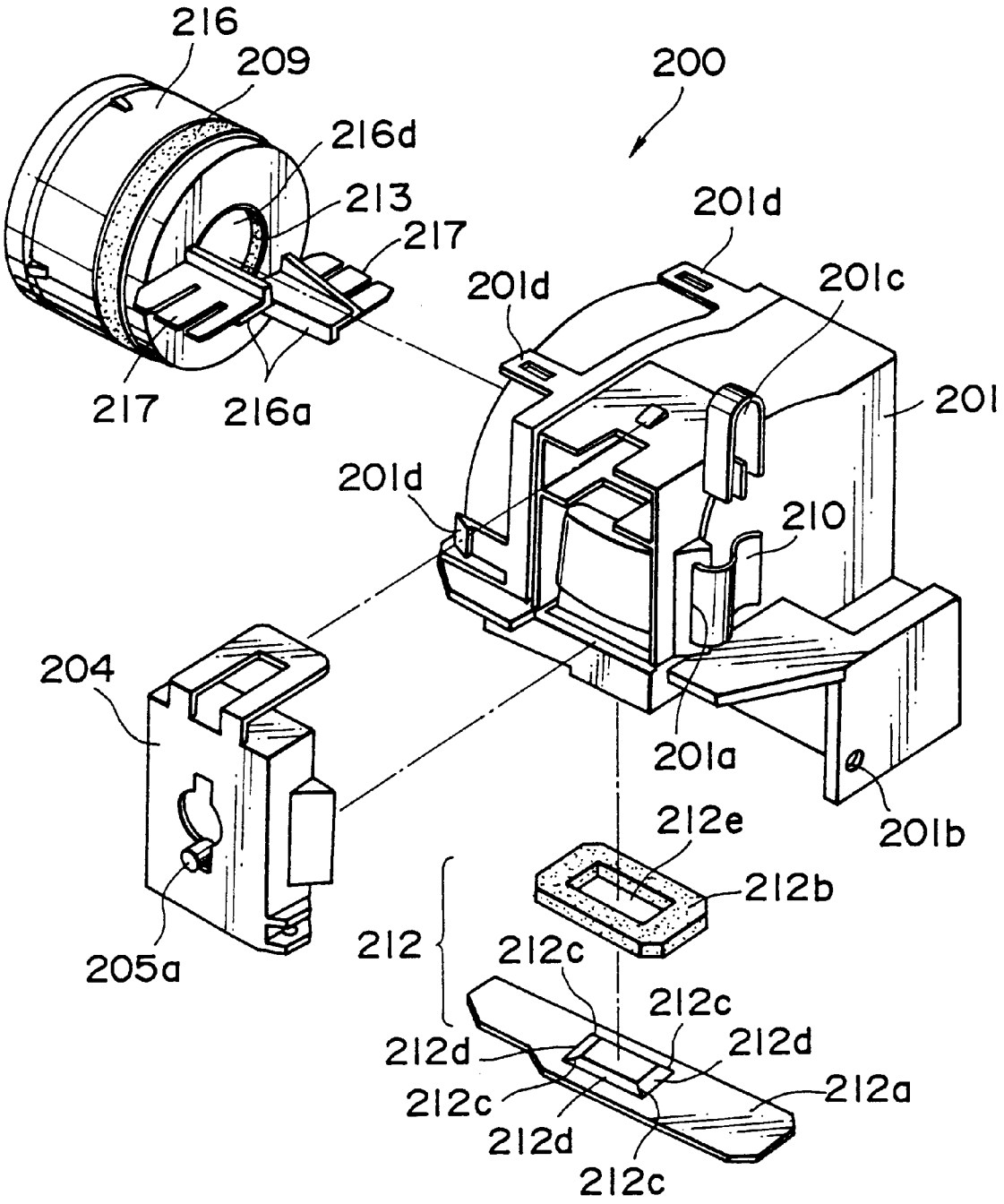
FIG. 5 is an exploded perspective view showing the construction of a lid member of the toner container.

As shown in FIG. 5, the seal member 212 comprises a thin plate 212*a* made of PET film and a sponge member 212*b* made of polyurethane foam which is directly stuck to the toner supply opening 12. The sponge member 212*b* is used to ensure elastic adhesion between the toner supply opening 12 and the toner discharge opening 204*a* and has an opening 212*e* bigger than the toner discharge opening 204*a* in the middle thereof, whereas the thin plate 212*a* has a plurality of notches 212*c* and flexible faces 212*d* at a part corresponding to the toner discharge opening 204*a*.

Figure 8A:
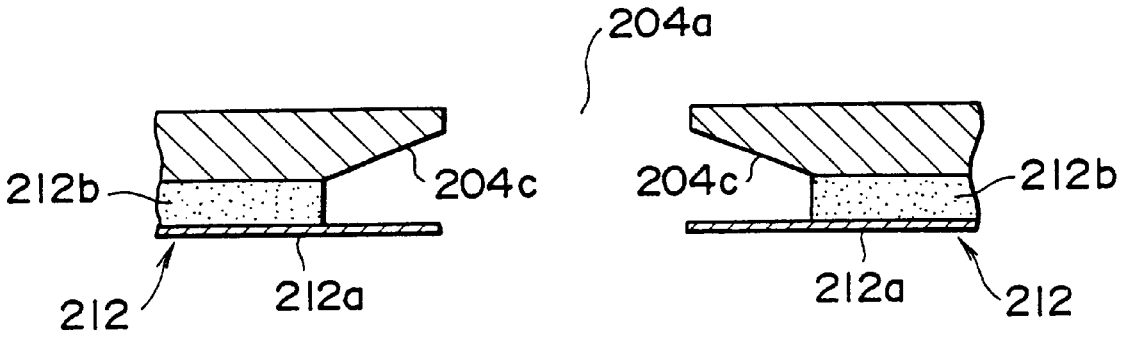
FIGS. 8(*a*) and 8(*b*) show the sealing of a toner discharge opening portion of the lid member of the toner container, FIG. 8(*a*) is a sectional view showing a state before the sealing is completed, and FIG. 8(*b*) is a sectional view showing a state in which the sealing has been completed.
Figure 8B:
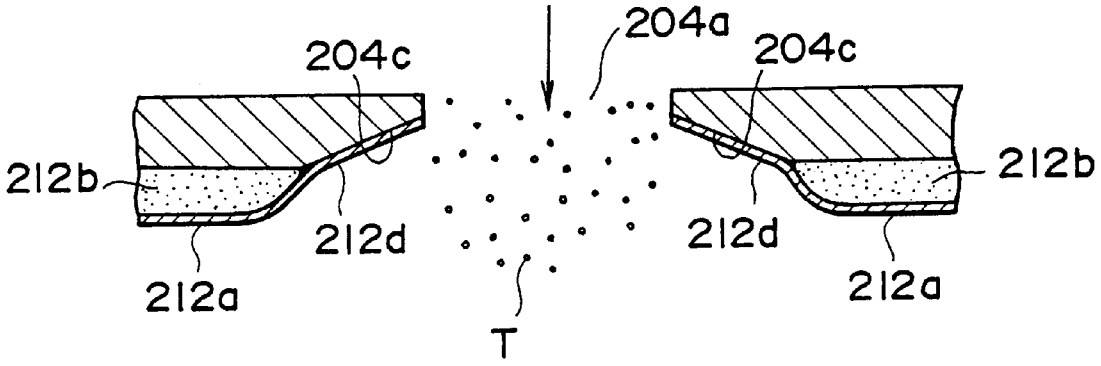

As shown in FIG. 8(*a*), around the toner discharge opening 204*a* in this embodiment, a tapered surface 204*c* is formed on the lower side in the drawing, i.e., on the side of a surface facing the toner supply opening 12. The size of the opening 212*e* of the sponge member 212*b* is determined to such an extent that the tapered surface 204*c* is not covered with the sponge member 212*b*.

The sponge member 212*b* is stuck on a part around the opening 204*a*, and the thin plate 212*a* is stuck on the sponge member 212*b*. The thin plate 212*a* is then bent with operator's fingers, so that its flexible part 212*d* is stuck on the tapered surface 204*c*. Thereby, there is formed a path of a chamfered construction having a sealing ability.

If the path between the toner discharge opening 204*a* and the toner supply opening 12 is constructed to have a vertical side wall, toner T is liable to adhere to the sponge member 212*b*. Accordingly, when the toner container 1000 is replaced, the toner T which has adhered to the sponge member 212*b* falls off because of vibrations, and the apparatus is contaminated with the toner T.

However, according to this embodiment, the sponge member 212*b* is covered with the thin plate 212*a*, and the path from the toner discharge opening 204*a* to the toner supply opening 12 has a tapered shape by the use of the thin plate 212*a*, as shown in FIGS. 8(*a*) and 8(*b*). Thus, the adhesion of the toner T to the sponge member 212*b* can be restrained to avoid toner contamination, and additionally a good sealing function can be obtained.

Figure 9:
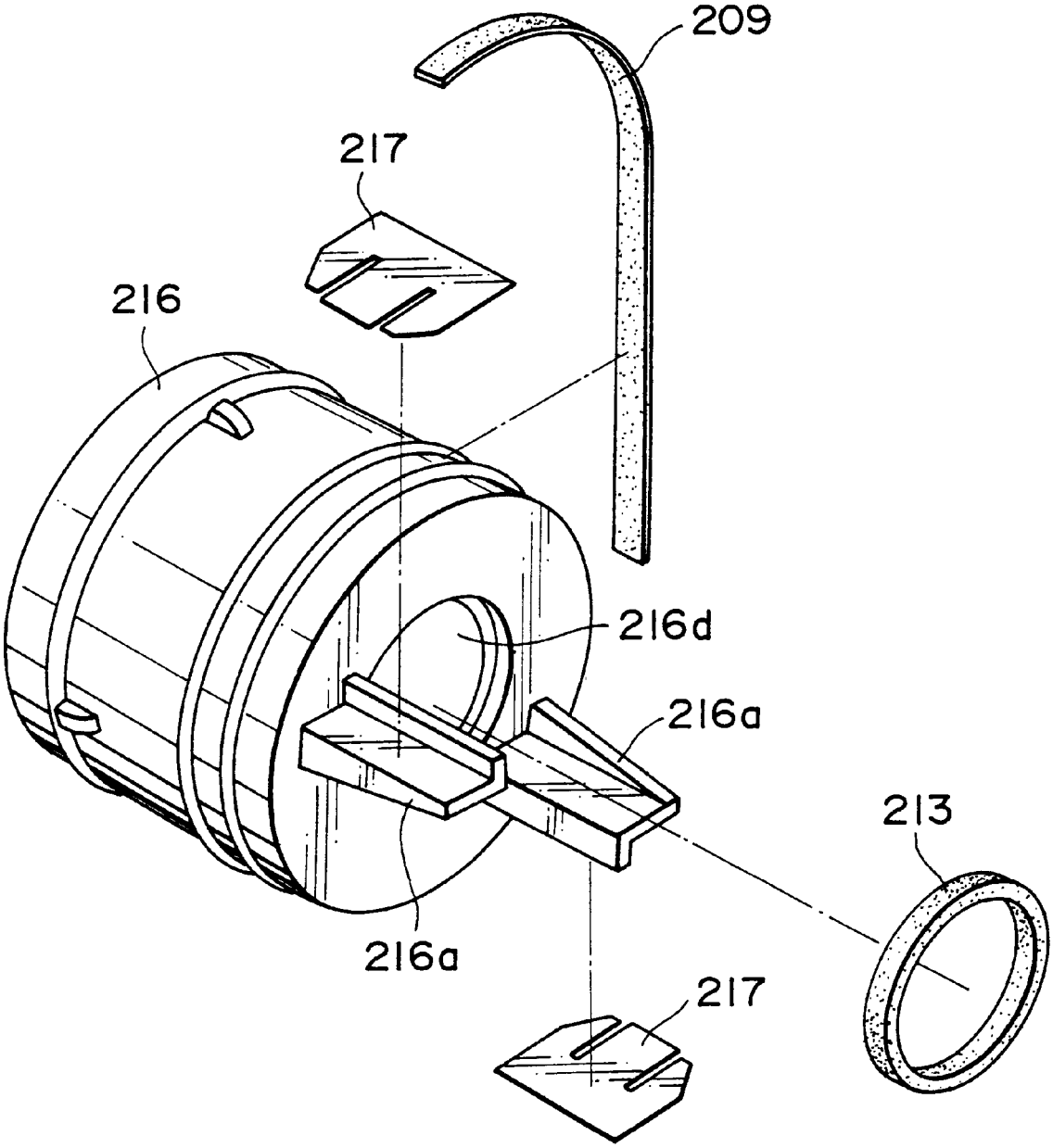
FIG. 9 is an exploded perspective view showing the construction of a toner supply flange of the lid member of the toner container.
Figure 10A:
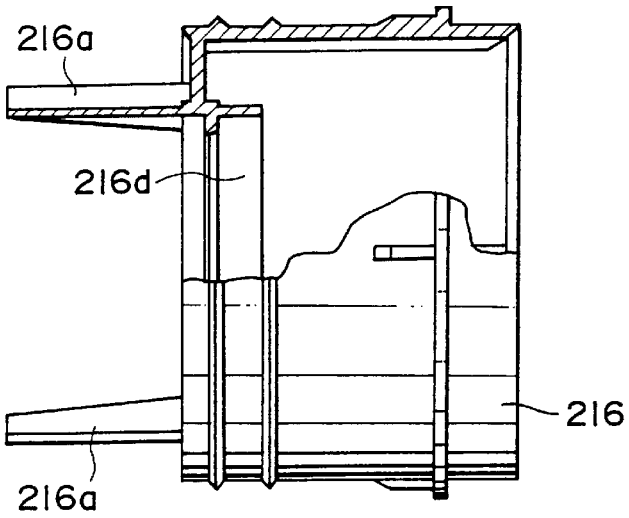
FIG. 10(*a*) is a partly sectional front view of the toner supply flange of the lid member of the toner container, FIG. 10(*b*) is a side view of FIG. 10(*a*). (A—A), (C—C), and (D—D) are sectional views taken along lines A—A, C—C, and D—D of FIG. 10(*b*), respectively, and (B—B) taken along line B—B of (A—A)
Figure 10B:
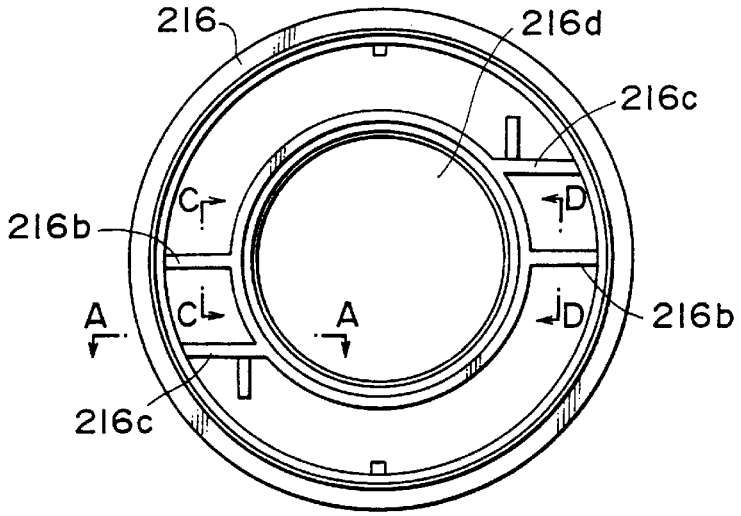
Figure 10B:
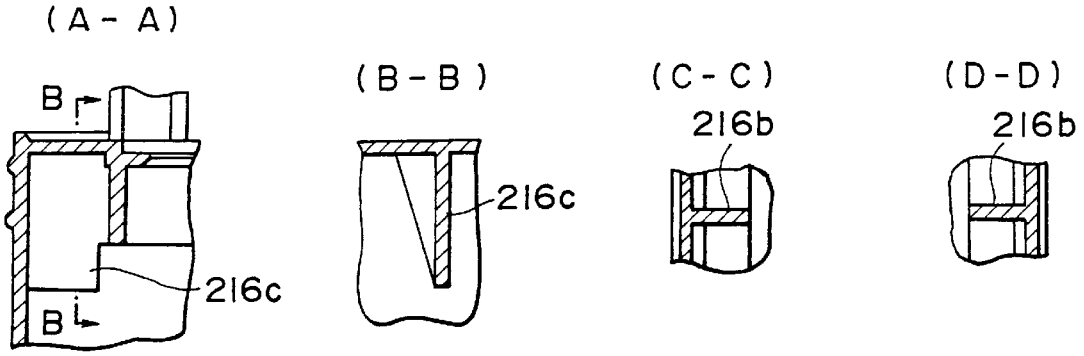

The inside of the lid body 201 of the lid member 200 is shaped cylindrically as shown in FIG. 2. A toner supply flange 216 is rotatably attached to the inside. As shown in FIGS. 9, 10(*a*), and 10(*b*), the flange 216 is shaped like a cylindrical cap and has an opening 216*d* in the middle of its end face. The toner discharge opening 114*d* of the toner bottle 100 is fitted in the opening 216*d* of the flange 216 by inserting the mouth portion 114*c* of the toner bottle 100 into the inside of the flange 216. Two brackets 216*a* substantially vertically jutting out of the end face of the flange 216 are mounted around the opening 216*d*. The brackets 216*a* are formed integrally with the flange 216. A toner pushing member 217 made of flexible material, such as PET film, is stuck to the bracket 216*a* with adhesive double coated tape.

The toner pushing member 217 is stuck thereto such that a free end of the toner pushing member 217 adheres elastically to the internal surface of the inside of the lid body 201 when the flange 216 is attached to the lid body 201, as shown in FIG. 2.

In order to seal a gap between the external surface of the flange 216 and the internal surface of the inside of the lid body 210, a band-like seal member 209 made of polyurethane foam is stuck to the external surface of the flange 216. Additionally, in order to seal a gap between the opening 216*d* of the flange 216 and the mouth portion 114*c* of the toner bottle 100, an annular seal member made of polyurethane foam is stuck to the part around the opening 216*d* with adhesive double coated tape.

Figure 11:
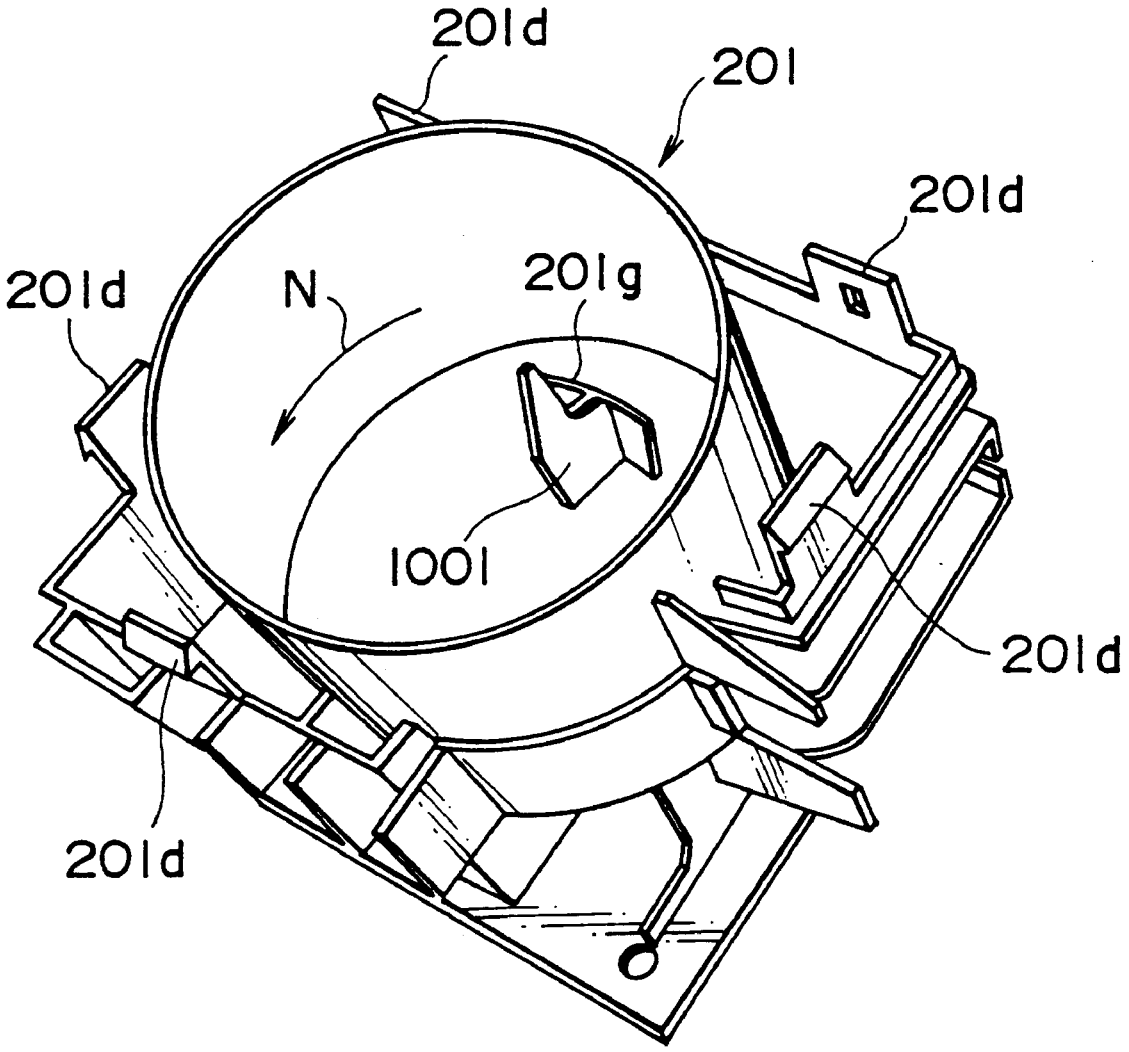
FIG. 11 is a perspective view showing the lid body of the lid member of the toner container.

As shown in FIG. 11, a sectionally T-shaped projection 201*g* is mounted on the bottom of the cylindrical lid body 201. The T-shaped projection 201*g* is arranged to be situated in the vicinity of the upper position in the toner discharge opening 114*d* when the toner bottle is set. A sheet-like scraper 1001 for scraping off toner around the toner discharge opening 114*d* is stuck to the middle of the projection 201*g* with adhesive double coated tape. Seeing from the rotational direction N of the toner bottle 100, the stuck position of the scraper 1001 is on the front side of the middle of the projection 201*g*.

The scraper 1001 is made of PET film and, as shown in FIG. 6, comprises a stuck part 1001*a* and a scraping part 1001*c* with an edge 1001*b*. When the toner bottle 100 is set, the scraper 1001 enters the toner discharge opening 114*d* of the toner bottle 100, and the edge 1001*b* of the scraper 1001 comes in contact with the circumferential surface around the opening 114*d*. Corresponding to the rotation of the toner bottle 100, the edge 1001*b* scrapes the circumferential surface.

In this way, the toner is prevented from stagnating around the toner discharge opening 114*d*, and a stable toner replenishment can be obtained.

The scraper 1001 is designed so that the scraper 1001 alone is bent when the scraper 1001 comes in contact with the toner bottle 100. For this reason, the scraper 1001 has a very weak sliding resistance and can hardly exert influence on the driving torque of the toner bottle 100. Additionally, since the stuck position of the scraper 1001 is on the front side of the middle of the projection 201*g* when seen from the rotational direction N of the toner bottle 100, the sliding resistance of the scraper 1001 to the toner discharge opening 114*d* acts to aid the scraper 1001 in sticking. As a result, the scraper 1001 is in a state difficult to tear off.

A description will be provided of the reason why the scraper 1001 is mounted.

In this type of toner container 1000, it is desirable to make the toner discharge opening 114*d* small in diameter, in order to improve the opening and closing function of the toner containing member. However, since the shortening of the diameter of the toner discharge opening 114*d* exerts an unfavorable influence on the flow of toner at the toner discharge opening 114*d*, there is an instance in which the toner discharge opening 114*d* is closed with some kind of toner, depending on the physical properties of the toner. For this reason, only toner excellent in fluidity can be used, in other words, there are certain restrictions as to the kind of toner to be used. Additionally, even toner excellent in fluidity at an ordinary temperature is liable to adhere to the part around the toner discharge opening 114*d* at a high temperature, and thereby a toner replenishment decreases. However, by mounting the scraper 1001 in the lid body 201, the adhesion of toner is avoided regardless of the kind of the toner or a change in temperature. Thus, an advantage of the present invention is that there is no restrictions on the type of an object to which the toner container is attached (i.e., the type of an image forming apparatus).

Figure 12:
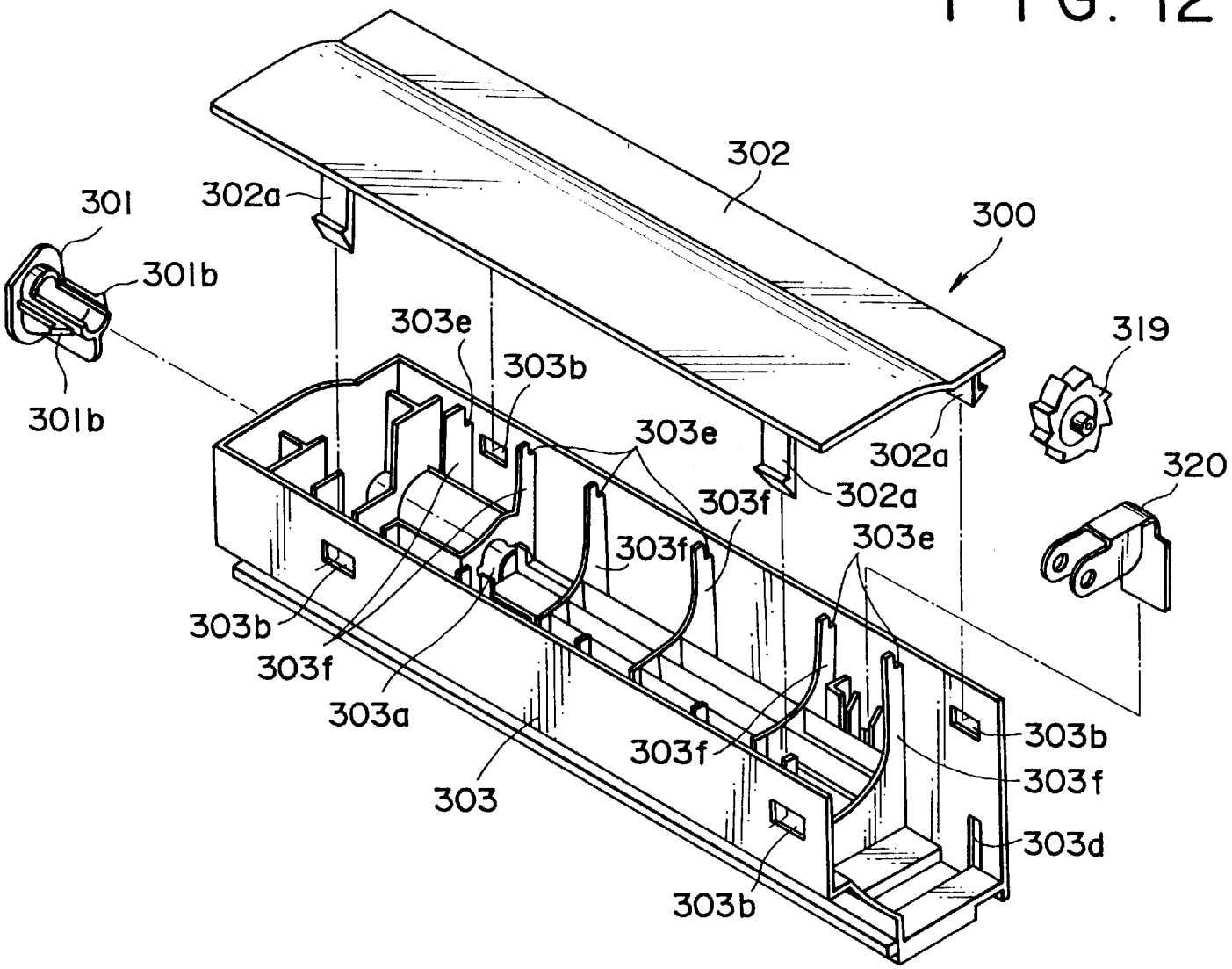
FIG. 12 is an exploded perspective view showing the construction of an armoring member of the toner container.
Figure 13:
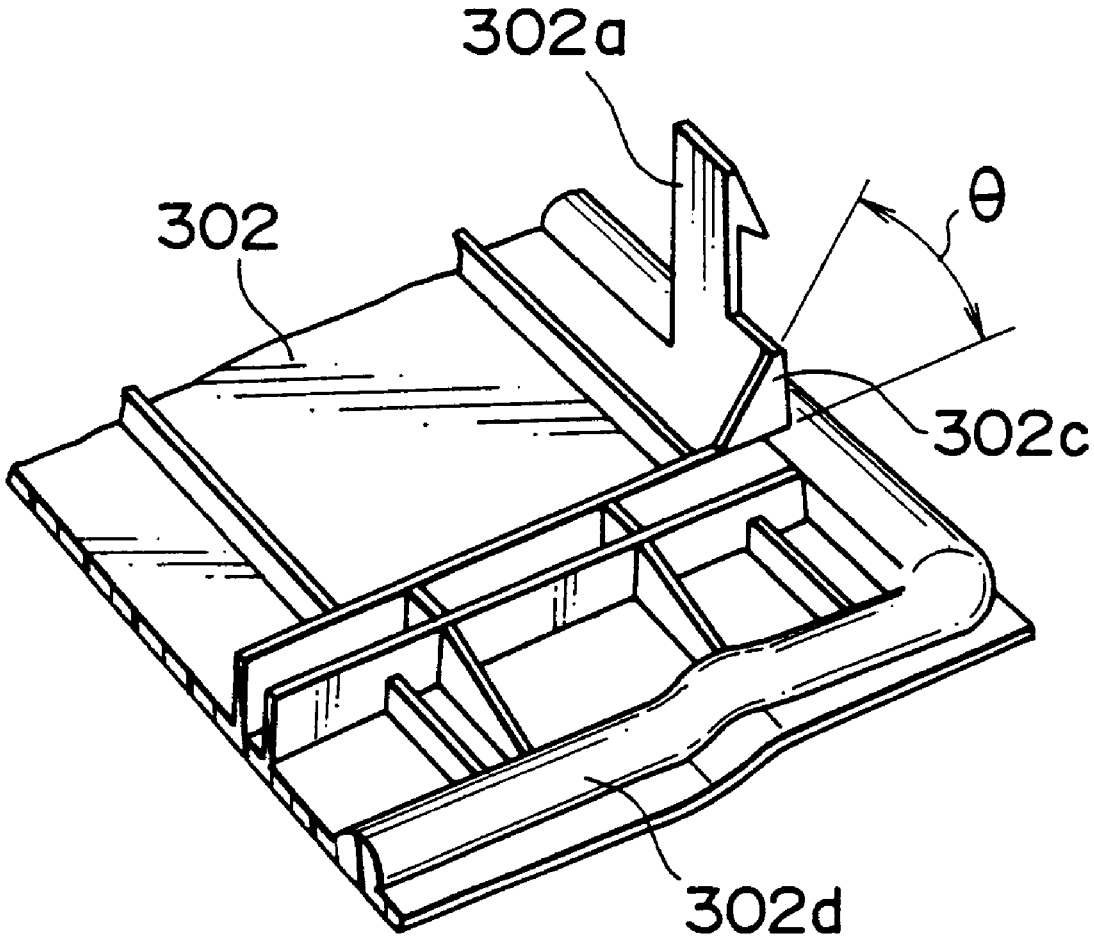
FIG. 13 is a perspective view showing a part of the reverse side of an upper case of the armoring member of the toner container.
Figure 14A:
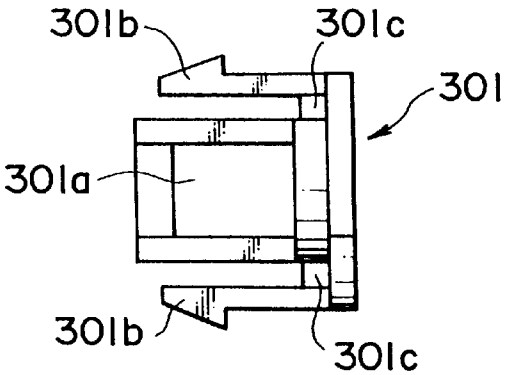
FIG. 14(*a*) is a top view showing the construction of a bearing of the armoring member of the toner container, FIG. 14(*b*) is a front view of FIG. 14(*a*), FIG. 14(*c*) is a sectional view thereof, and FIG. 14(*d*) is a rear view thereof.
Figure 14B:
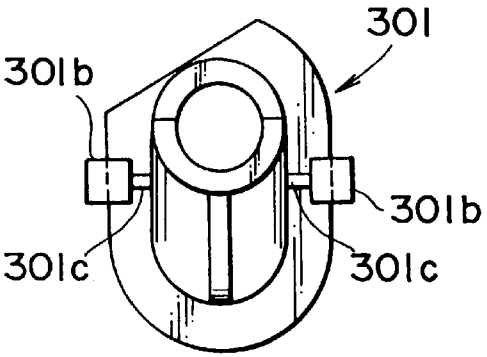
Figure 14C:
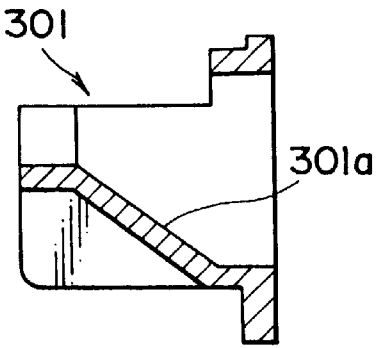
Figure 14D:
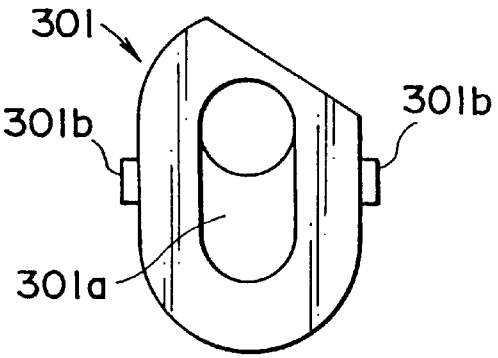

As shown in FIG. 12, the armoring member 300 comprises a bearing 301, an upper case 302, and a lower case 303. In this embodiment, the upper and lower cases 302, 303 are fixed to each other by the engagement of claws 302*a* formed on the upper case 302 with holes 303*b* formed in the lower case 303, respectively. Therefore, there is no need to use an adhesive agent or the like when they are assembled into the armoring member 300. Thus, the assembly or disassembly of the parts is facilitated. The upper case 302 is made of polystyrene (PS), and the claws 302*a* are each set to be about 1.5 mm in thickness. In order to maintain the strength of the claw 302*a* and because of difficulty in obtaining predetermined accuracy when molded (when manufactured), a reinforcing rib 302*c* is formed integrally with the root of the claw 302*a*, as shown in FIG. 13 which is a partial view showing a state where the upper case 302 is reversed. The angle θ of the reinforcing rib 302*c* is set at 45 degrees. The reinforcement of the reinforcing rib 302*c* ensures the locking function performed by the engagement between the claw 302*a* and the hole 303*b* for a long time.

Referring further to FIG. 13, a plurality of ribs extending in longitudinal and lateral directions of the upper case 302 are formed on the rear face of the upper case 302. Additionally, an engagement rib 302*d* semi-spherical in section is formed on the rear face all over the periphery of the upper case 302. Corresponding to the engagement rib 302*d*, reinforcing ribs 303*f* each of which has notched concaves 303*e* at the upper part thereof are formed in the lower case 303. When the upper case 302 is fitted to the lower case 303, the engagement rib 302*d* is engaged with the notched concaves 303*e*.

As a result of mounting the engagement rib 302*d*, the strength of the upper case 302 itself is further heightened. Additionally, regardless of whether the distance between both the walls of the lower case 303 which extend in the longitudinal direction is shorter or longer than a predetermined length, accurate dimension and positioning are obtained by fitting the upper case 302 to the lower case 303 so that the engagement rib 302*d* is engaged with the notched concaves 303*e*. The aforementioned walls of the lower case 303 to which the upper case 302 has been fitted cannot be crushed even if the walls are pressed inward. In other words, the engagement rib 302*d* serves to supplement a weak point occurring when the armoring member 300 is constructed out of separate parts, and accordingly the strength of all the cases of the armoring member 300 is maintained. Additionally, as described above, since accurate length and positioning are obtained by fitting the upper case 302 to the lower case 303 regardless of errors in dimension, strict requirements for accuracy in manufacturing can be moderated, and therefore productivity can be improved.

The bearing 301 is fixed to the lower case 303 such that a snap claw 301*b*, as shown in FIG. 14(*a*), extending in the axial direction of the bearing 301 is fitted, with a snap, to a bearing-supporting portion 303*a* of the lower case 303 of the armoring member 300 shown in FIG. 12. As shown in FIGS. 14(*a*) and 14(*b*), a rib 301*c* for regulating the bend of the snap claw 301*b* is formed at the root of the snap claw 301*b*. Thereby, the snap claw 301*b* is prevented from excessively bending inward and reaching a loose state of engagement.

Figure 15A:
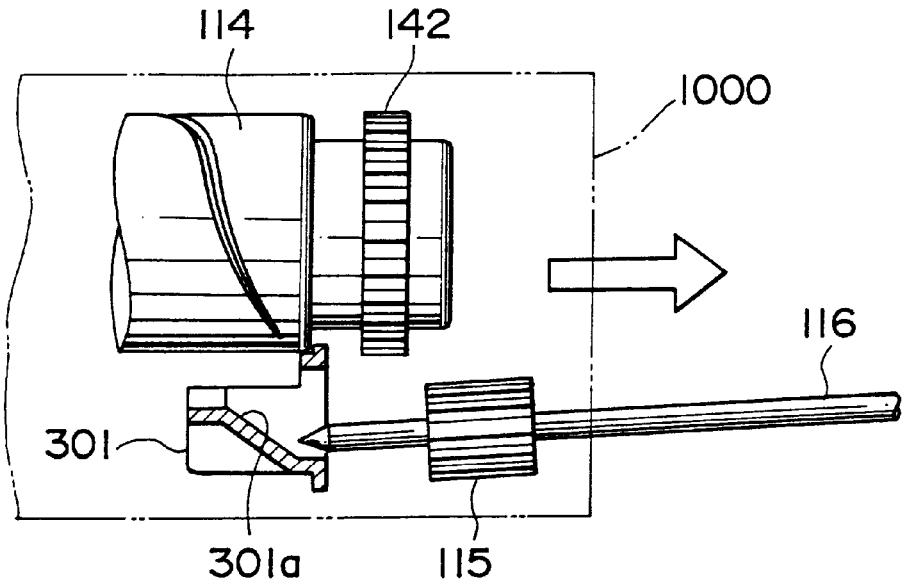
FIGS. 15(*a*) and 15(*b*) are descriptive drawings for describing the engagement between a bottle gear of a toner bottle of the toner container and a driving gear for driving the toner container, FIG. 15(*a*) shows a state immediately before the gears are engaged with each other, and FIG. 15(*b*) shows a state in which the gears are in engagement with each other.
Figure 15B:
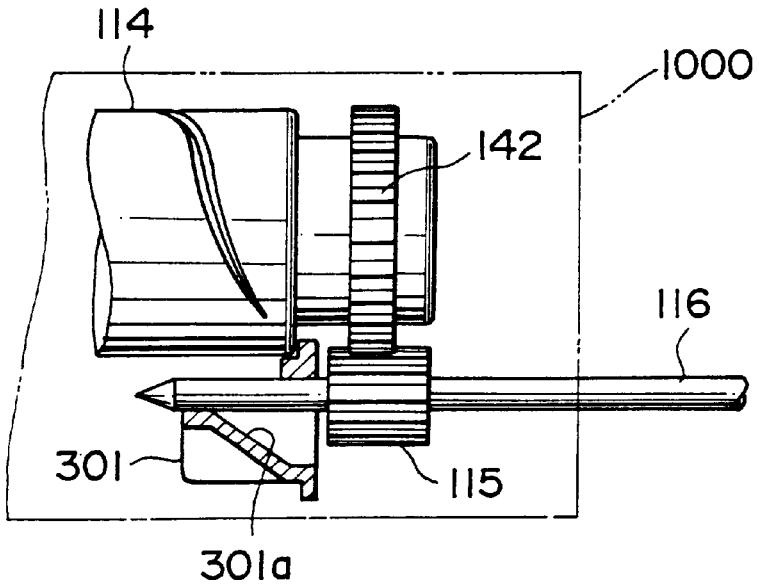
Figure 16A:
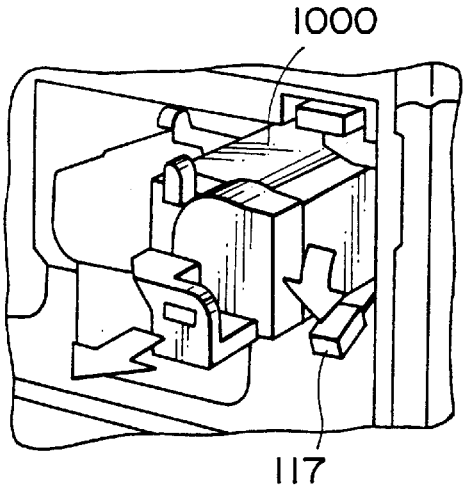
FIGS. 16(*a*) to 16(*d*) show procedure for attaching the toner container to the image forming apparatus.
Figure 16B:
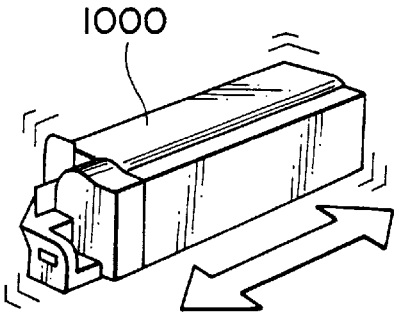
Figure 16C:
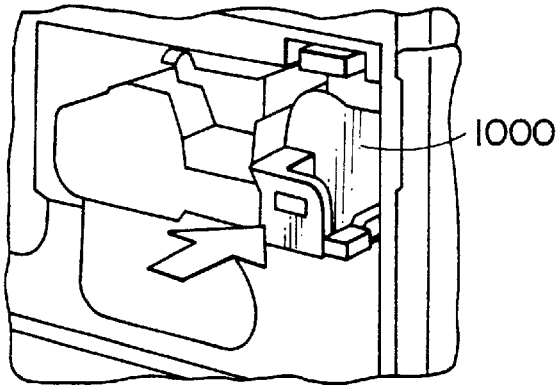
Figure 16D:
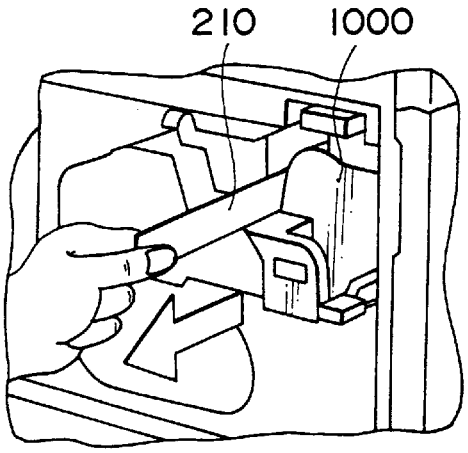

As shown in FIG. 14(*c*), a tapered portion 301*a* is mounted on the lower side of the axis of the bearing 301. As shown in FIGS. 15(*a*) and 15(*b*), the tapered portion 301*a* serves to slide the tip of the driving shaft 116 of the toner-container-driving gear 115 disposed on the side of the apparatus on an inclined face of the tapered portion 301*a* from below to above when the toner container 1000 is inserted into the apparatus. Thereby, the toner-container-driving gear 115 comes in engagement with the bottle gear 142 mounted on the bottle portion 114 of the toner bottle 100 from a direction perpendicular to its rotational axis, and thus the toner container 1000 is very smoothly attached to the apparatus. In contrast, in a conventional toner bottle, a bottle gear is engaged with a toner-container-driving gear from an axial direction parallel to each other. Therefore, interference occurs between the gears. This makes it difficult to attach the toner container to the apparatus.

A bottle tapping roller 319 with ratchet-like teeth on its periphery is fixed to the lower case 303 of the armoring member 300 via a roller supporting bracket 320 made of a flat spring. With the toner bottle 100 housed in the armoring member 300, the bottle tapping roller 319 is disposed to be in elastic contact with the side face of the bottle portion 114. Accordingly, when the toner bottle 100 rotates under a toner supplying operation which will be later described, the roller 319 is rolled because of differences in level of the circumferential surface of the bottle portion 114 and gives vibrations to the toner bottle 100. Thus, the toner is prevented from adhering to the inner surface of the toner bottle 100. It is conventionally known to adopt a structure in which the toner is prevented from adhering to the inner surface of the toner bottle by giving vibrations to the toner bottle. However, in the conventional structure, since a plate, such as a spring plate, is used as a bottle tapping member, there is a problem in that the plate gives a loud tap at difference portions in level of the surface of the toner bottle. In contrast, in the present invention, since the roller is used as the bottle tapping member, the roller rolls on the difference portions with a low noise.

A description will now be provided of a toner supplying operation performed when the toner container 1000 is attached to the image forming apparatus. In FIGS. 2 and 3, when a toner density sensor 34 comprising a permeability sensor for detecting the permeability of a developer detects that the toner density of a developer circulating in the developer container is less than a reference toner density, a driving portion (not shown) mounted on the side of the apparatus is actuated to turn the toner-container-driving gear 115 shown in FIGS. 15(*a*) and 15(*b*). As described above, the toner-container-driving gear 115 comes in engagement with the bottle gear 142 of the toner bottle 100 by setting the toner container 1000 in the apparatus. Accordingly, the toner bottle 100 is rotated in a predetermined direction correspondingly to the rotation of the toner-container-driving gear 115 that is in engagement with the bottle gear 142.

At this time, projections 114*a* (see FIG. 4) formed on the head of the toner bottle 100 are engaged with ribs 216*b* (see FIG. 10(*b*)) formed on the internal wall of the toner supply flange 216, respectively, and thereby the toner bottle 100 is rotated simultaneously with the rotation of the flange 216.

There is a situation in which the toner bottle 100 runs idle for disengagement between the projection 114*a* and the rib 216*b* which is caused by abrasion, or the like, of the projection 114*a*. As an auxiliary to prevent the idling, projections 216*c* to be engaged with an inclined portion 114*b* of the shoulder of the toner bottle 100 are formed on the internal surface of the flange 216.

By the rotation of the toner bottle 100, the toner is conveyed toward the opening formed in the end of the toner container 1000 by the aid of the toner conveying function of the spiral rib 114*f* of the bottle portion 114, and is discharged from the toner discharge opening 114*d*. The discharged toner is first caused to flow into a toner hopper (in a rotation path of the toner pushing member 217) defined between the lid body 201 and the flange 216, as shown in FIG. 2. Corresponding to the rotation of the flange 216, the toner in the toner hopper is then raked and pushed up to flow on the inner circumferential surface of the lid body 201 by means of the toner pushing member 217 that is rotated substantially simultaneously with the rotation of the flange 216. When the toner pushing member 217 passes the gate 219, the toner is pushed out of the inside of the lid body 201 through the slit 219*a* of the gate 219.

The toner that has been pushed out therefrom falls inside the toner discharge cover 204 attached to the side wall of the lid body 201 and then is supplied to the development unit through the toner discharge opening 204*a* formed in the lower part of the toner discharge cover 204 and the toner supply opening 12 of the development unit which faces the toner discharge opening 204*a*. The toner supply to the development unit is controlled by the toner density sensor 34 that detects the toner density of a developer circulating in the developer container. In more detail, when the toner density sensor 34 detects a state where the toner density of the developer has reached a reference toner density after the toner is supplied from the toner container 1000 to the developing unit, the driving shaft 116 of the toner-container-driving gear 115 is stopped from rotating, and thereby the toner supply is stopped.

The toner is timely supplied to the development unit in this way, and a toner end display (not shown) mounted in the apparatus is lighted when all the toner in the toner bottle 100 is used up. A user sees the bright display and ascertains that the toner bottle 100 contains no toner. The user then replaces the empty toner container with a new toner container filled with toner. Taking the steps shown in FIGS. 16(*a*) to 16(*d*), the old toner container is replaced with the new one.

The replacement will be described in detail. As shown in FIG. 16(*a*), the user first opens a front cover of the apparatus and presses a stopper 117 down, and then takes the old toner container 1000 out of the apparatus. After that, as shown in FIG. 16(*b*), the user shakes a new toner container 1000 five or six times so that toner in the toner container 1000 can flow easily and smoothly. Next, as shown in FIG. 16(*c*), the new toner container 1000 is attached to the apparatus. At this time, the user ascertains whether the new toner container 1000 has been properly set therein or not by hearing a locking snap of the stopper 117 or by discerning a locked position. Thereafter, as shown in FIG. 16(*d*), a gate seal 210 of the new toner container 1000 is drawn out. Thereby, the toner is ready to be supplied. At the end, the user closes the front cover.

On the other hand, the positioning of the toner container 1000 with respect to the process cartridge is carried out by the engagement of a positioning hole 201*b* (see FIG. 5) formed in a handle of the lid member 200 of the toner container 1000 with a positioning pin 118 (see FIG. 1) of the process cartridge, and the positioning of the toner container 1000 with respect to the apparatus is carried out by the engagement of a positioning hole 201*c* (see FIG. 5) formed in the lid body 201 of the toner container 1000 with a positioning pin (not shown) of the apparatus. The lid member 200 is positioned and fastened to the apparatus, and thereby the armoring member 300 is simultaneously positioned and fastened to the apparatus. In the event that a combination of the lid member 200 with the armoring member 300 is regarded as an armoring member, the same step is taken.

Figure 17A:
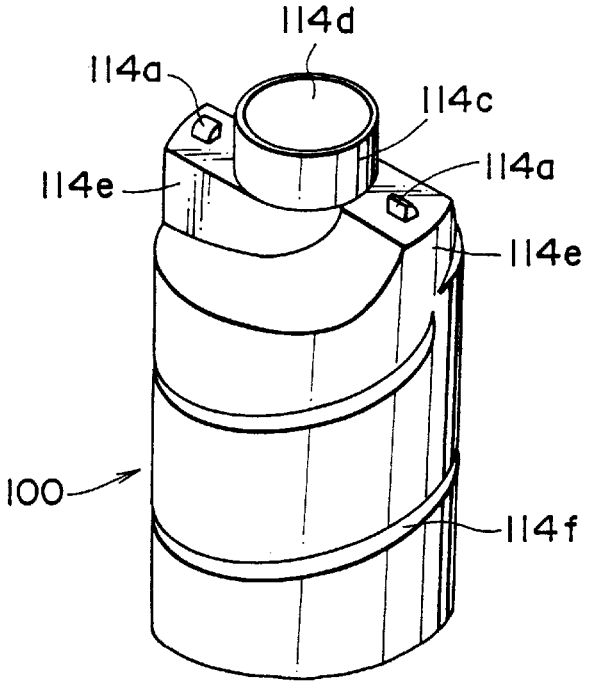
FIG. 17(*a*) is a perspective view showing the shape of a shoulder of the toner bottle of the present invention, and FIG. 17(*b*) is a perspective view showing the shape of a shoulder of a conventional toner bottle.
Figure 17B:
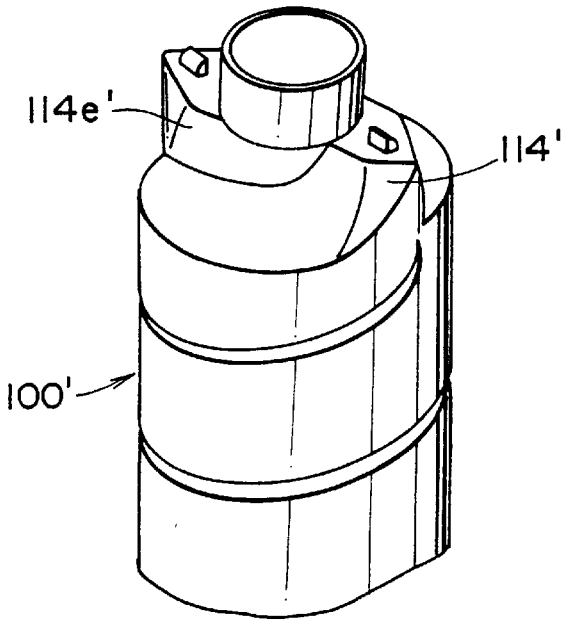
FIG. 17(b) PRIOR ART

In this embodiment, as shown in FIG. 17(*a*), the shoulder of the mouth portion 114*c* of the toner bottle 100 is shaped such that the width of a spiral groove 114*e* used as a toner conveying path is greater than that of a spiral groove 114*e* of a conventional toner bottle 100' shown in FIG. 17(*b*). Therefore, the toner bottle 100 according to this embodiment discharges more toner per rotation than the conventional toner bottle 100'. This makes it possible to put a sufficient quantity of toner into the toner hopper of the lid member 200 of the toner container 1000, and thus always stably supply the toner from the toner container 1000 to the development unit.

What is claimed is:

1. A toner container used to supply toner comprising:

a cylindrical toner containing member containing the toner and having a toner outlet at an end portion thereof in a center axis direction thereof, such that toner contained in said toner containing member is conveyed to the toner outlet upon said toner containing member being rotated by a driving force;

a lid member having a toner discharge opening from which the toner conveyed through a toner outlet of said toner containing member is discharged; and an armoring member in which said toner containing member is housed and to which said lid member is attached;

wherein both of or one of said lid member and said armoring member is shaped quadrangularly in external appearance, wherein said toner containing member conveys the toner contained therein to said toner outlet thereof and discharges the toner from said toner outlet by driving force.

2. A toner container used to supply toner comprising:

toner containing member containing the toner;

a lid member having a toner discharge opening from which the toner conveyed through a toner outlet of said toner containing member is discharged; and an armoring member in which said toner containing member is housed and to which said lid member is attached;

wherein both of or one of said lid member and said armoring member is shaped quadrangularly in external appearance, wherein said lid member has a toner supply mechanism for supplying the toner discharged from said toner outlet of said toner containing member to a development unit through said toner discharge opening of said lid member.

3. A toner container used to supply toner comprising:

a cylindrical toner containing member containing the toner and having a toner outlet through which the toner is discharged, said toner outlet being located at an end portion of the toner containing member in a center axis direction thereof, such that toner contained in said toner containing member is conveyed to the toner outlet upon said toner containing member being rotated by a driving force; and an armoring member in which said toner containing member is housed said armoring member being constructed as a constituent part independent of said toner containing member;

said toner container having a double construction comprising said toner containing member and said armoring member, wherein said toner containing member conveys the toner contained therein to said toner outlet thereof and discharges the toner from said toner outlet by driving force.

4. A toner container used to supply toner comprising:

a cylindrical toner containing member containing the toner and having a toner outlet at an end portion thereof in a center axis direction thereof, such that toner contained in said toner containing member is conveyed to the toner outlet upon said toner containing member being rotated by a driving force;

a lid member having a toner discharge opening from which the toner conveyed through a toner outlet of said toner containing member is discharged; and an armoring member in which said toner containing member is housed and to which said lid member is attached, said armoring member being constructed as a constituent part independent of said toner containing member;

said toner container having a double construction comprising said toner containing member and said armoring member, wherein said toner containing member conveys the, toner contained therein to said toner outlet thereof and discharges the toner from said toner outlet by driving force.

5. A toner container used to supply toner comprising:

toner containing member, containing the toner;

a lid member having a toner discharge opening from which the toner conveyed through a toner outlet of said toner containing member is discharged; and an armoring member in which said toner containing member is housed and to which said lid member is attached, said armoring member being constructed as a constituent part independent of said toner containing member;

said toner container having a double construction comprising said toner containing member and said armoring member, wherein said lid member has a toner supply mechanism for supplying the toner conveyed from said toner outlet of said toner containing member to a development unit through said toner discharge opening of said lid member.

6. An image forming apparatus including a development unit and a toner container used to supply toner to said development unit, wherein said toner container comprises:

a cylindrical toner containing member containing the toner and having a toner outlet at an end portion thereof in a center axis direction thereof, such that toner contained in said toner containing member is conveyed to the toner outlet upon said toner containing member being rotated by a driving force;

a lid member having a toner discharge, opening from which the toner conveyed through a toner outlet of said toner containing member is discharged; and an armoring member in which said toner containing member is housed and to which said lid member is attached;

wherein both of or one of said lid member and said armoring member is shaped quadrangularly in external appearance, wherein said toner containing member conveys the toner contained therein to said toner outlet thereof and discharges the toner from said toner outlet by driving force.

7. An image forming apparatus including a development unit and a toner container used to supply toner to said development unit, wherein said toner container comprises:

a cylindrical toner containing member containing the toner and having a toner outlet through which the toner is discharged, said toner outlet being located at an end portion of the toner containing member in a center axis direction thereof, such that toner contained in said toner containing member is conveyed to the toner outlet upon said toner containing member being rotated by a driving force; and an armoring member in which said toner containing member is housed, said armoring member being constructed as a constituent part independent of said toner containing member;

said toner container having a double construction comprising said toner containing member and said armoring member, wherein said toner containing member conveys the toner contained therein to said toner outlet thereof and discharges the toner from said toner outlet by driving force.

8. An image forming apparatus including a development unit and a toner container used to supply toner to said development unit, wherein said toner container comprises:

a cylindrical toner containing member containing the toner and having a toner outlet at an end portion thereof in a center axis direction thereof, such that toner contained in said toner containing member is conveyed to the toner outlet upon said toner containing member being rotated by a driving force;

a lid member having a toner discharge opening from which the toner conveyed through a toner outlet of said toner containing member is discharged; and an armoring member in which said toner containing member is housed and to which said lid member is attached, said armoring member being constructed as a constituent part independent of said toner containing member;

said toner container having a double construction comprising said toner containing member and said armoring member, wherein said toner containing member conveys the, toner contained therein to said toner outlet thereof and discharges the toner from said toner outlet by driving force.

9. The image forming apparatus of claim 1, wherein said toner containing member has an engagement portion which is engaged with a driving member for rotating and driving the toner containing member, and wherein said armoring member has an opening for rotating and driving the toner containing member by engagement of the driving member with the engagement portion.

10. The image forming apparatus of claim 3, wherein said toner containing member has an engagement portion which is engaged with a driving member for rotating and driving the toner containing member, and wherein said armoring member has an opening for rotating and driving the toner containing member by engagement of the driving member with the engagement portion.

11. The image forming apparatus of claim 4, wherein said toner containing member has an engagement portion which is engaged with a driving member for rotating and driving the toner containing member, and wherein said armoring member has an opening for rotating and driving the toner containing member by engagement of the driving member with the engagement portion.

12. The image forming apparatus of claim 6, wherein said toner containing member has an engagement portion which is engaged with a driving member for rotating and driving the toner containing member, and wherein said armoring member has an opening for rotating and driving the toner containing member by engagement of the driving member with the engagement portion.

13. The image forming apparatus of claim 7, wherein said toner containing member has an engagement portion which is engaged with a driving member for rotating and driving the toner containing member, and wherein said armoring member has an opening for rotating and driving the toner containing member by engagement of the driving member with the engagement portion.

14. The image forming apparatus of claim 8, wherein said toner containing member has an engagement portion which is engaged with a driving member for rotating and driving the toner containing member, and wherein said armoring member has an opening for rotating and driving the toner containing member by engagement of the driving member with the engagement portion.

* * * * *